US010504483B2

(12) United States Patent
Chen et al.

(10) Patent No.: US 10,504,483 B2
(45) Date of Patent: Dec. 10, 2019

(54) DISPLAY METHOD AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Chungchun Chen, Beijing (CN); Peng Liu, Beijing (CN); Pengcheng Lu, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/102,093

(22) PCT Filed: Sep. 18, 2015

(86) PCT No.: PCT/CN2015/089996
§ 371 (c)(1),
(2) Date: Jun. 6, 2016

(87) PCT Pub. No.: WO2016/192241
PCT Pub. Date: Dec. 8, 2016

(65) Prior Publication Data

US 2017/0110087 A1 Apr. 20, 2017

(30) Foreign Application Priority Data

Jun. 5, 2015 (CN) ..... 2015 1 303504

(51) Int. Cl.
*G09G 5/02* (2006.01)
*G09G 3/20* (2006.01)
*G09G 5/00* (2006.01)

(52) U.S. Cl.
CPC ..... *G09G 5/026* (2013.01); *G09G 3/2003* (2013.01); *G09G 5/005* (2013.01);
(Continued)

(58) Field of Classification Search
None
See application file for complete search history.

(56) References Cited

U.S. PATENT DOCUMENTS 8,502,758 B2 8/2013 Beland et al.
2001/0028358 A1* 10/2001 Tanizawa ..... G06T 3/4007 345/660

(Continued)

FOREIGN PATENT DOCUMENTS

| | | | |
|---|---|---|---|
| CN | 103886808 | A | 6/2014 |
| CN | 103886809 | A | 6/2014 |
| CN | 103903549 | A | 7/2014 |
| CN | 104680948 | A | 6/2015 |
| CN | 104835444 | A | 8/2015 |

OTHER PUBLICATIONS

International Search Report with Notice of Transmittal of the International Search Report of PCT/CN2015/089996 dated Feb. 15, 2016 in Chinese with English translation.

(Continued)

*Primary Examiner* — Aaron M Richer
(74) *Attorney, Agent, or Firm* — Collard & Roe, P.C.

(57) ABSTRACT

A display method and a display device are disclosed. The display method is applicable in display panels in which sub-pixels are arranged in a triangle-shaped arrangement manner. The display method includes generating an original image including a plurality of first virtual pixels (2) according to image information; calculating a display component of a second virtual sub-pixel (31) according to display components of first virtual sub-pixels (21) of a same color as the second virtual sub-pixel (31) in at least one first virtual pixel (2); and calculating a display component of a sub-pixel (Continued)

(11) according to display components of second virtual sub-pixels (31) of a same color as the sub-pixel (11) in at least two adjacent second virtual pixels (3).

15 Claims, 7 Drawing Sheets

(52) U.S. Cl.
CPC ..... *G09G 2300/0443* (2013.01); *G09G 2300/0452* (2013.01); *G09G 2340/0407* (2013.01); *G09G 2340/0457* (2013.01); *G09G 2340/06* (2013.01)

(56) References Cited

U.S. PATENT DOCUMENTS

| | | | | |
|---|---|---|---|---|
| 2011/0140999 | A1 | 6/2011 | Beland et al. | |
| 2013/0147805 | A1* | 6/2013 | Chang | H04N 7/0117 345/428 |
| 2016/0027359 | A1 | 1/2016 | Guo et al. | |
| 2016/0027369 | A1 | 1/2016 | Guo et al. | |

OTHER PUBLICATIONS

Written Opinion of the International Searching Authority of PCT/CN2015/089996 dated Feb. 3, 2016 in Chinese with English translation.
Extended European Search Report in European Application No. 15891404.4-1209 / 3306598, dated Dec. 19, 2018.

* cited by examiner

DISPLAY METHOD AND DISPLAY DEVICE

CROSS REFERENCE TO RELATED APPLICATIONS

This application is the National Stage of PCT/CN2015/089996 filed on Sep. 18, 2015, which claims priority under 35 U.S.C. § 119 of Chinese Application No. 201510303504.5 filed on Jun. 5, 2015, the disclosure of which is incorporated by reference.

TECHNICAL FIELD

Embodiments of the present disclosure relate to a display method and a display device.

BACKGROUND

A display device is provided with a display panel including a plurality of pixels. In case that each of the pixels includes a red sub-pixel R, a green sub-pixel G and a blue sub-pixel B, the sub-pixels can be arranged in a strip-shaped arrangement manner as illustrated in FIG. 1(*a*) in which the sub-pixels are arranged in arrays or can be arranged in a triangle-shaped arrangement manner as illustrated in FIG. 1(*b*). For the strip-shaped arrangement manner, in a row direction, the sub-pixels are arranged repeatedly in a sequence according to colors; and in a column direction, sub-pixels of a same color are arranged with alignment. For the triangle-shaped arrangement manner, in a row direction, the sub-pixels are arranged repeatedly in a sequence according to colors; and in a column direction, adjacent sub-pixels have different colors and locations offset from each other with a half of one sub-pixel. A color mixture of the sub-pixels in the triangle-shaped arrangement manner is more uniform than that of the sub-pixels in the strip-shaped arrangement manner, thus the triangle-shaped arrangement manner can improve an image quality.

SUMMARY

At least one embodiment of the present disclosure provides a display method and a display device, which utilize technical solutions as below.

A display method, applicable in a display panel in which sub-pixels are arranged in a triangle-shaped arrangement manner, the display method includes: generating an original image including a plurality of first virtual pixels according to image information, each of the first virtual pixels includes a plurality of first virtual sub-pixels of different colors, the first virtual sub-pixels are arranged in a strip-shaped arrangement manner; calculating a display component of a second virtual sub-pixel according to display components of first virtual sub-pixels of a same color as the second virtual sub-pixel in at least one first virtual pixel, the second virtual sub-pixel and the sub-pixel having a same length in a row direction and in a column direction, and a second virtual pixel includes a plurality of second virtual sub-pixels of different colors; and calculating a display component of a sub-pixel according to display components of second virtual sub-pixels of a same color as the sub-pixel in at least two adjacent second virtual pixels.

In addition, embodiments of the present disclosure also provide a display device, including: a display panel having a plurality of sub-pixels arranged in a triangle-shaped arrangement manner; an original image generating module configured to generate an original image including a plurality of first virtual pixels according to image information, each of the first virtual pixels including a plurality of first virtual sub-pixels of different colors, the first virtual sub-pixels being arranged in a strip-shaped arrangement manner; a display component calculating module configured to calculate a display component of a second virtual sub-pixel according to display components of first virtual sub-pixels of a same color as the second virtual sub-pixel in at least one first virtual pixel, the second virtual sub-pixel and the sub-pixel having a same length in a row direction and a column direction, and a second virtual pixel including a plurality of second virtual sub-pixels of different colors, and configured to calculate a display component of a single sub-pixel according to display components of second virtual sub-pixels of a same color as the sub-pixel in at least two adjacent second virtual pixels, a location of the sub-pixel being overlapped with a location of one of the second virtual sub-pixels; and a display driving module configured to drive sub-pixels of the display panel to display according to the display components.

BRIEF DESCRIPTION OF THE DRAWINGS

Embodiments of the present disclosure will be described in detail hereinafter in conjunction with accompanying drawings to allow one of ordinary skill in the art to understand the present disclosure more clearly, in which.

DETAILED DESCRIPTION

Technical solutions of the embodiment will be described in a clearly and fully understandable way in connection with the drawings related to the embodiments of the present disclosure. It is apparent that the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present application, are not intended to indicate any sequence, amount or importance, but for distinguishing various components. Also, the terms, such as "a/an," "the" or the like, are not intended to limit the amount, but for indicating the existence of at lease one. The terms, such as "comprise/comprising," "include/including," or the like are intended to specify that the elements or the objects stated before these terms encompass the elements or the objects and equivalents thereof listed after these terms, but not preclude other elements or objects. The terms, "on," "under," or the like are only used to indicate relative position relationship, and when the position of the object which is described is changed, the relative position relationship may be changed accordingly.

The inventors realized that, a length of a sub-pixel in column direction in a triangle-shaped arrangement manner is the same as a length of a sub-pixel in column direction in a strip-shaped arrangement manner, and a length of a sub-pixel in row direction in a triangle-shaped arrangement manner is larger than a length of a sub-pixel in row direction in a strip-shaped arrangement manner; as a result, an amount of sub-pixels in a display panel with the triangle-shaped arrangement manner is less than an amount of sub-pixels in a display panel with the strip-shaped arrangement manner so that a resolution of a display panel with the triangle-shaped arrangement manner is lower than a resolution of a display panel with the strip-shaped arrangement manner. Moreover, a display effect of lines in a frame in the triangle-shaped arrangement manner is far less than a display effect of lines in a frame in the display panel with the strip-shaped arrangement manner.

Embodiment I

Figure 1:
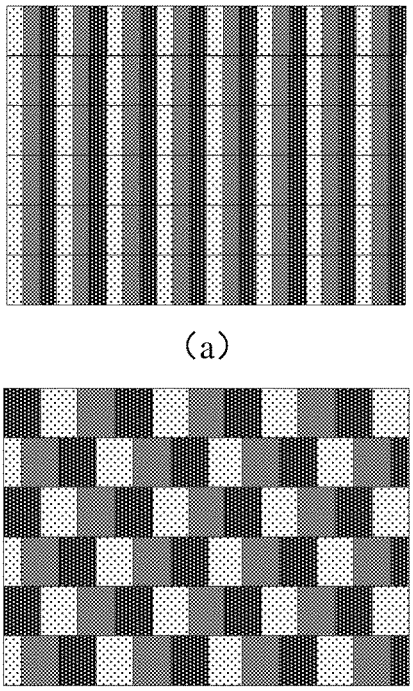
FIG. 1 is a schematic diagram illustrating an arrangement manner of sub-pixels, wherein FIG. 1(*a*) is a schematic diagram illustrating a strip-shaped arrangement manner of sub-pixels, and FIG. 1(*b*) is a schematic diagram illustrating a triangle-shaped arrangement manner of sub-pixels.
Figure 2:
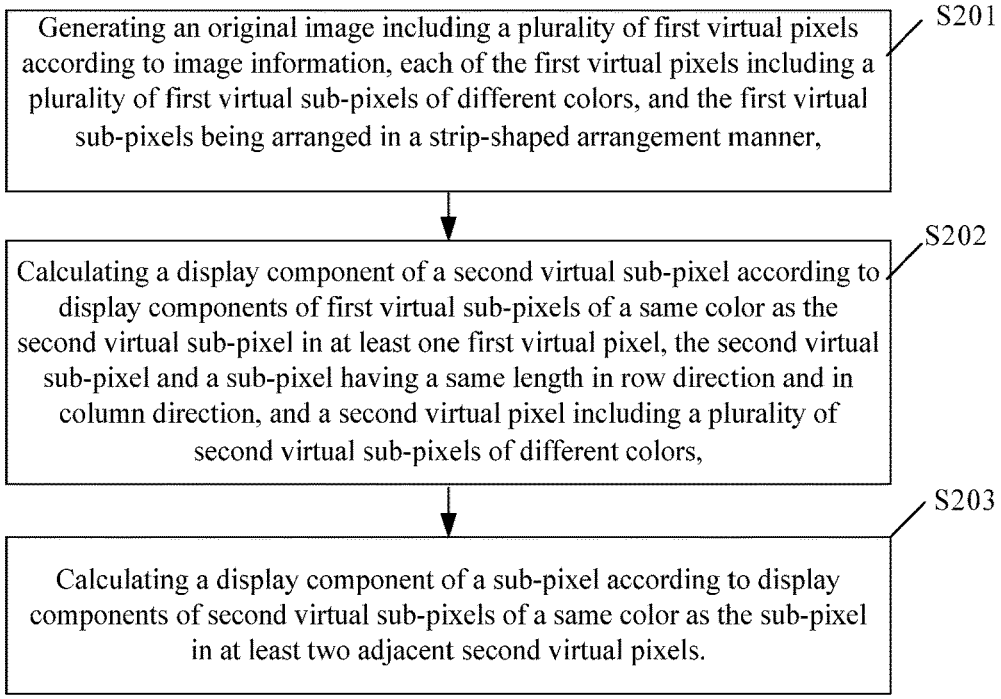
FIG. 2 is a flow chart illustrating a display method as provided by an embodiment of the present disclosure.

Embodiments of the present application provide a display method applicable in display panels in which sub-pixels are arranged in a triangle-shaped arrangement manner as illustrated in FIG. 1(*b*). As illustrated in FIG. 2, the display method includes steps as below.

S201, generating an original image including a plurality of first virtual pixels according to image information. Each of the first virtual pixels includes a plurality of first virtual sub-pixels of different colors. The first virtual sub-pixels are arranged in a strip-shaped arrangement manner.

For example, the original image is generated by processing the image information of display frames. The original image includes a plurality of first virtual pixels. Optionally, each of the first virtual pixels can include a first virtual red sub-pixel R, a first virtual green sub-pixel G and a first virtual blue sub-pixel B. The original image can also include first virtual sub-pixels of other colors, such as a first virtual white sub-pixel W, however, the present application is not limited thereto.

S202, calculating a display component of a second virtual sub-pixel according to display components of first virtual sub-pixels of a same color as the second virtual sub-pixel in at least one first virtual pixel. The second virtual sub-pixel and a sub-pixel have a same length in row direction and in column direction, and a second virtual pixel includes a plurality of second virtual sub-pixels of different colors.

Exemplarily, the step can be achieved by the following two solutions.

In a first solution, calculating a sum of products of multiplying display components of first virtual sub-pixels of a same color in at least two adjacent first virtual pixels by respective proportional coefficients to obtain a display component of a second virtual sub-pixel of the same color, and the second virtual sub-pixel has an overlapping area with a single first virtual sub-pixel. It is understood that the display component can be represented by "brightness", or can be represented by other measurement parameters, such as "gray scale", "saturation" and the like. In addition, in the at least two adjacent first virtual sub-pixels, a difference in intervals between every two adjacent first virtual pixels is no greater than two first virtual pixels. Moreover, the at least two first virtual sub-pixels can be two first virtual sub-pixels, or can be more than two first virtual sub-pixels, for example, three first virtual sub-pixels. In order to reduce calculation workload, it is selected to calculate a display component of a second virtual sub-pixel according to display components of first virtual sub-pixels of a same color as the second virtual sub-pixel in two adjacent first virtual pixels. In order to facilitate sampling the first virtual sub-pixel, it can calculate a display component of a second virtual sub-pixel according to display components of first virtual sub-pixels of a same color as the second virtual sub-pixel in two adjacent first virtual pixels.

In the embodiment above, exemplarily, the proportional coefficients can be 0, 0.1, 0.35, 0.5, 0.85, 0.9, 1 and the like. For example, given that a sum of proportional coefficients of all the first virtual sub-pixels used for calculating the display component of the second virtual sub-pixel equals to 1, then an overall display component of an image constituted by the second virtual pixel is the same as an overall display component of the original image.

For example, a sum of proportional coefficients of all the first virtual sub-pixels used for calculating the display component of the second virtual sub-pixel equals to 1, and each of proportional coefficients of the first virtual sub-pixels are identical with each other. In this way, the calculation is relatively simple, and a sum of all the proportional coefficients equals to 1, which allows a good image quality.

The first virtual sub-pixels of a same color in at least two adjacent first virtual pixels include: a first virtual sub-pixel having a same location and a same color as a second virtual sub-pixel in a single first virtual pixel, and a first virtual sub-pixel of a same color as the second virtual sub-pixel in at least one first virtual pixel adjacent to the single first virtual pixel in row direction or column direction; or include: a first virtual sub-pixel having a same location and a same color as a second virtual sub-pixel in a single first virtual pixel, a first virtual sub-pixel of a same color as the second virtual sub-pixel in at least one first virtual pixel adjacent to the single first virtual pixel in row direction, and a first virtual sub-pixel of a same color as the second virtual sub-pixel in at least one first virtual pixel adjacent to the single first virtual pixel in column direction.

In a second solution, calculating a display component of a second virtual sub-pixel according to a display component of a single first virtual sub-pixel of a same color as the second virtual sub-pixel. The second virtual sub-pixel has an overlapping area with the first virtual sub-pixel. Exemplarily, the second virtual sub-pixel is obtained by multiplying a single first virtual sub-pixel by a value greater than 0 and smaller than 1. The above value can be 0.1, 0.2, 0.5, 0.8 and the like.

As compared with the solution in which the second virtual sub-pixel is obtained by calculation of a single first virtual sub-pixel, the solution in which the second virtual sub-pixel is obtained by calculating at least two adjacent first virtual sub-pixels can improve a visual resolution of the display frame.

Optionally, each of the second virtual pixels can include a second virtual red sub-pixel R, a second virtual green sub-pixel G and a second virtual blue sub-pixel B, or can also include second virtual sub-pixels of other colors, such as a second virtual white sub-pixel W. Colors of the second virtual sub-pixels contained in the second virtual pixel can be the same as or different from those of the first virtual sub-pixels contained in the first virtual pixel. Exemplarily, each of the first virtual pixels includes a first virtual red sub-pixel R, a first virtual green sub-pixel G, a first virtual blue sub-pixel B and a first virtual white sub-pixel W, while each of the second virtual pixels includes a second virtual red sub-pixel R, a second virtual green sub-pixel G and a second virtual blue sub-pixel B; in this case, the first virtual white sub-pixel W in the first virtual pixel can serve to improve a brightness of the second virtual pixel.

S203, calculating a display component of a sub-pixel according to display components of second virtual sub-pixels of a same color as the sub-pixel in at least two adjacent second virtual pixels. A location of the sub-pixel is overlapped with a location of a single second virtual sub-pixel.

In at least two adjacent second virtual pixels, a difference in intervals between every two adjacent second virtual pixels is no more than two second virtual pixels. For example, at least two virtual sub-pixels can be two second virtual sub-pixels, or can be more than two second virtual sub-pixels, such as three second virtual sub-pixels. In order to reduce calculation workload, for example, calculating a display component of a sub-pixel according to display components of second virtual sub-pixels of a same color as the sub-pixel in two adjacent second virtual pixels.

Exemplarily, calculating a display component of a sub-pixel according to display components of second virtual sub-pixels of a same color as the sub-pixel in at least two adjacent second virtual pixels includes: calculating a sum of products of multiplying display components of second virtual sub-pixels of a same color in two adjacent second virtual pixels by respective proportional coefficients to obtain a display component of a sub-pixel of the same color as the second virtual sub-pixel. In case that the each of the proportional coefficients equal to 1, it can be: calculating a sum of display components of second virtual sub-pixels of a same color in two adjacent second virtual pixels to obtain a display component of a sub-pixel of the same color as the second virtual sub-pixel. In addition, in order to facilitate sampling the second virtual sub-pixel, for example, a display component of a sub-pixel can be calculated according to display components of second virtual sub-pixels of a same color as the sub-pixel in two adjacent second virtual pixels.

The second virtual sub-pixel and the sub-pixel have a same length in row direction and column direction, and the display component of the sub-pixel is obtained by calculation on display components of two adjacent second virtual sub-pixels, which can improve a visual resolution. Furthermore, a line displayed by two second virtual sub-pixels is displayed by a single sub-pixel, which can optimize a display effect of lines in a display frame.

The second virtual sub-pixels of a same color in at least two adjacent second virtual pixels include: a second virtual sub-pixel having a same location and a same color as a sub-pixel in a single second virtual pixel, and a second virtual sub-pixel of a same color as the sub-pixel in a second virtual pixel adjacent to the single second virtual pixel in row direction or column direction.

Figure 3:
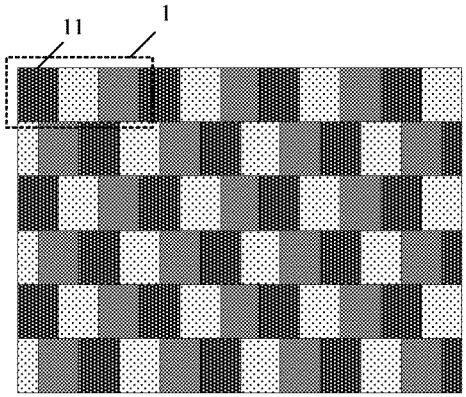
FIG. 3 is a schematic diagram illustrating a first structure of a display panel as provided by an embodiment of the present disclosure.
Figure 4:
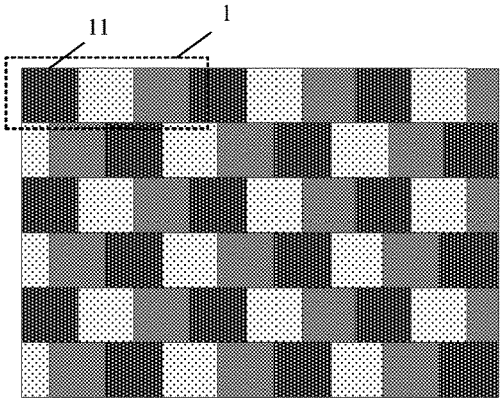
FIG. 4 is a schematic diagram illustrating a second structure of a display panel as provided by an embodiment of the present disclosure.

For being understood by an ordinary skill in the art, the display method as provided by embodiments of the present disclosure are described in details with reference to two structures of display panel as illustrated in FIG. 3 and FIG. 4, respectively. In a first structure as illustrated in FIG. 3, sub-pixels 11 in the display panel are arranged in a triangle-shaped arrangement manner, a length of the sub-pixel 11 in row direction is ⅔ of a length thereof in column direction; in a second structure as illustrated in FIG. 4, sub-pixels 11 in the display panel are arranged in a triangle-shaped arrangement manner, a length of the sub-pixel 11 in row direction equaling to a length thereof in column direction. The display panel can have other structures. The present disclosure is not limited thereto.

Exemplarily, embodiments of the present disclosure provide three display methods. The first structure of the display panel can be used in the first display method and the second display method, while the second structure of the display panel can be used in the first display method, the second display method and the third display method. As a result, in the first display method and the second display method, description is exemplarily given with reference to the first structure of the display panel, and the display method of the second structure may refer to the display method of the first structure; and in the third display method, description is exemplarily given with reference to the second structure of the display panel.

Figure 5:
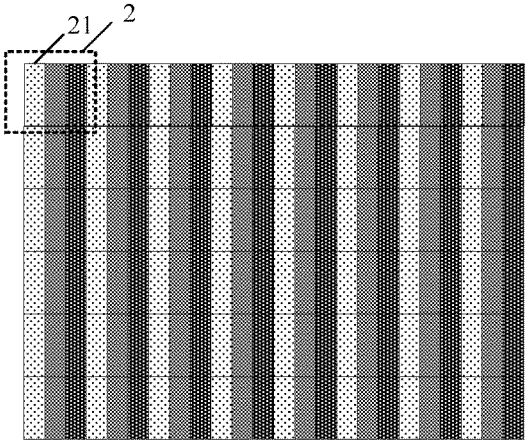
FIG. 5 is a schematic diagram illustrating a structure of an original image as provided by an embodiment of the present disclosure.

It is explained that, in the following three display methods, as illustrated in FIG. 5, the original image in the step S201 includes a plurality of first virtual pixels 2, each of the first virtual pixels 2 includes a plurality of first virtual sub-pixels 21 of different colors. The first virtual sub-pixels 21 are arranged in a strip-shaped arrangement manner. A length of the first virtual sub-pixel 21 in column direction is the same as a length of the sub-pixel 11 in column direction, and a length of the first virtual sub-pixel 21 in row direction is ⅓ of a length of the first virtual sub-pixel 21 in column direction. Exemplarily, each of the first virtual pixels 2 includes a first virtual red sub-pixel R, a first virtual green sub-pixel G and a first virtual blue sub-pixel B.

The calculation method of "calculating a display component of a sub-pixel according to display components of second virtual sub-pixels of a same color as the sub-pixel in two adjacent second virtual pixels" is similar to the calculation method of "calculating a display component of a sub-pixel according to display components of second virtual sub-pixels of a same color as the sub-pixel in at least two adjacent second virtual pixels", hereinafter the calculation method is described by an example of "calculating a display component of a sub-pixel according to display components of second virtual sub-pixels of a same color as the sub-pixel in two adjacent second virtual pixels."

The sampling of "first virtual sub-pixels of a same color in at least two adjacent first virtual pixels" and the sampling of "second virtual sub-pixels of a same color in at least two adjacent second virtual pixels" can be implemented by plenty of types of manners, and the sampling methods are similar, so only several manners thereof are exemplarily described in the following three display methods. Other sampling situations may refer to those as described herein, and no details are repeated herein.

Display Method I

The first solution in step S202 is described as below.

Exemplarily, "first virtual sub-pixels of a same color in at least two adjacent first virtual pixels" in the first solution of step S202 includes: a first virtual sub-pixel having a same location and a same color as a second virtual sub-pixel in a single first virtual pixel, and a first virtual sub-pixel of a same color as the second virtual sub-pixel in at least one first virtual pixel adjacent to the above single first virtual pixel in a row column.

Figure 6:
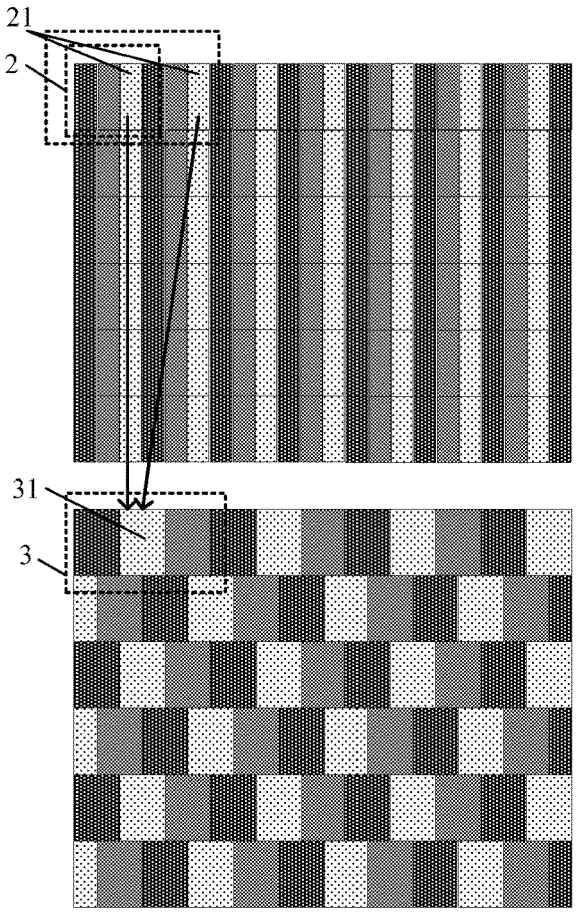
FIG. 6 is a schematic diagram illustrating a corresponding relationship between a second virtual sub-pixel and a first virtual sub-pixel in a first display method as provided by an embodiment of the present disclosure.

Only display components of first virtual sub-pixels of a same color in two adjacent first virtual pixels are selected for calculating the display component of the second virtual sub-pixel of the same color, it can simplify the selection and also the calculation of the display components of the second virtual sub-pixel. As a result, hereinafter it is exemplarily described as illustrated in FIG. 6. That is, "first virtual sub-pixels of a same color in two adjacent first virtual pixels" includes: a first virtual sub-pixel 21 having a same location and a same color as a second virtual sub-pixel 31 in a single first virtual pixel 2, for example, as illustrated in FIG. 6, a second virtual sub-pixel 31 is at a first location of a first row, while a first virtual sub-pixel 21 of a same color as the second virtual sub-pixel 31 is also at a first location in a first row; and a first virtual sub-pixels 21 of a same color as the second virtual sub-pixel 31 in a first virtual pixel 2 adjacent to the above first virtual pixel 2 in row direction, for example, as illustrated in FIG. 6, a second virtual sub-pixel 31 is at a first location of a first row, while a first virtual pixel 2 where the second first virtual sub-pixel 21 is located is at a same row as and adjacent to a first virtual pixel 2 where the above first virtual sub-pixel 21 at the first location of the first row is located.

In such case, "calculating a display component of a second virtual sub-pixel according to display components of first virtual sub-pixels of a same color as the second virtual sub-pixel in two adjacent first virtual pixels" can be performed as below.

As illustrated in FIG. 6, calculating a sum of products of multiplying display components of first virtual sub-pixels 21 of a same color in two adjacent first virtual pixels 2 in row direction by respective proportional coefficients to obtain a display component of a second virtual sub-pixel 31 of the same color as the first virtual sub-pixels 21. Exemplarily, given that the display components of the two first virtual sub-pixels 21 of the same color are B1 and B2 respectively, and that the corresponding proportional coefficients are 0.3 and 0.6 respectively, then the display component of the second virtual sub-pixel 31 is B3=B1*0.3+B2*0.6. In such case, an overall display component of an image constituted by all the second virtual pixels 3 is smaller than an overall display component of the original image.

For example, a sum of proportional coefficients of all the first virtual sub-pixels 21 used for calculating the display component of the second virtual sub-pixel 31 equals to 1, and the proportional coefficients of the first virtual sub-pixels 21 are identical with each other; as a result, an overall display component of an image constituted by all the second virtual pixels 3 is the same as an overall display component of the original image.

As illustrated in FIG. 6, the second virtual sub-pixel 31 is co-determined by two first virtual sub-pixels 21, so it can improve a visual resolution of a display panel constituted by the second virtual pixels 3 and allow it being approximate to a physical resolution of a display panel in a strip-shaped arrangement manner.

Figure 7:
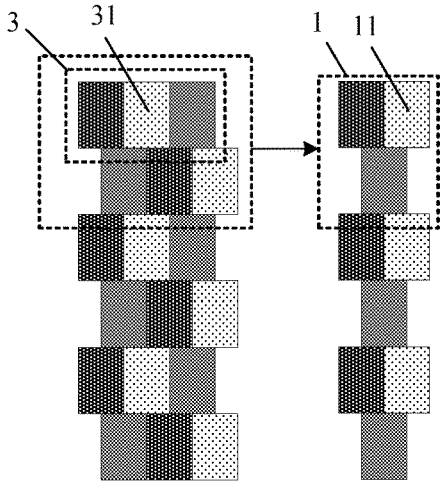
FIG. 7 is a schematic diagram illustrating a corresponding relationship between a sub-pixel and the second virtual sub-pixel in a first display method as provided by an embodiment of the present disclosure.

Subsequently, as illustrated in FIG. 7, "second virtual sub-pixels of a same color in two adjacent second virtual pixels" in step S203 includes: a second virtual sub-pixel 31 in a single second virtual pixel 3 having a same location and a same color as a sub-pixel 11; and a second virtual sub-pixel 31 of a same color as the sub-pixel 11 in a second virtual pixel 3 adjacent to the above single second virtual pixel 3 in column direction.

In such case, "calculating a display component of a sub-pixel according to display components of second virtual sub-pixels of a same color as the sub-pixel in two adjacent second virtual pixels" in step S203 includes: as illustrated in FIG. 7, calculating a sum of products of multiplying display components of second virtual sub-pixels 31 of a same color in two adjacent second virtual pixels 3 in column direction by respective proportional coefficients to obtain a display component of a sub-pixel 11 of the same color as the second virtual sub-pixels 31. In case that each of the above proportional coefficients equals to 1, by calculating a sum of display components of second virtual sub-pixels 31 of a same color in two adjacent second virtual pixels 3 in column direction, it can obtain the display component of the sub-pixel 11 of the same color as the second virtual sub-pixels 31. Exemplarily, given that the display components of two second virtual sub-pixels 31 of the same color both are B3, the display component of the sub-pixel 11 equals to a sum of products of multiplying display components of the two second virtual sub-pixels 31 by respective proportional coefficients, that is, B4=B3*0.1+B3*0.3; or it can also equal to a sum of display components of the two second virtual sub-pixels 31, that is, B4=2*B3.

In conventional technology, for a display panel with the first structure, both the visual resolution of display frames and the display effect of lines in the display frames are poorer than that of display frames in a strip-shaped arrangement manner. In embodiments of the present disclosure, as illustrated in FIG. 7, since the sub-pixel 11 is calculated from display components of two adjacent second virtual sub-pixels 21, it can improve the visual resolution of display frames. In addition, in the column direction, a line displayed by two adjacent second virtual sub-pixels 31 is displayed by a single sub-pixel 11, that is, a line in the column direction of the display frame is displayed by a pixel 1; furthermore, since a length (hereinafter referred to as "width") of the pixel 1 in a row direction is ⅔ of a width of a second virtual pixel 3 while the width of the second virtual pixel 3 is 2 times of a width of a first virtual pixel 2, the width of the pixel 1 is 4/3 times of the width of the first virtual pixel 2, that is, nearly the same as the width of the first virtual pixel 2; as a result, the display effect of a line in the column direction of the display frame is similar to the display effect of a line in the column direction of a display frame with a strip-shaped arrangement manner.

Hereinafter the second solution in step S202 is described.

Figure 8:
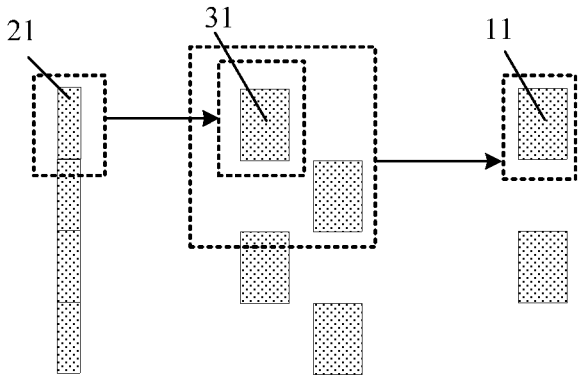
FIG. 8 is a schematic diagram illustrating a first display method as provided by an embodiment of the present disclosure.

Exemplarily, as illustrated in FIG. 8, "calculating a display component of a second virtual sub-pixel according to a display component of a single first virtual sub-pixel of a same color as the second virtual sub-pixel" in the second solution in step S202 can be: calculating a product of multiplying a display component of a single first virtual sub-pixel by a value greater than 0 and smaller than 1 to obtain a display component of a second virtual sub-pixel of a same color as the single first virtual sub-pixel; exemplarily, given that the display component of the first virtual sub-pixel 21 is B1, multiplying B1 by a value, such as 0.5, to obtain the display component of the second virtual sub-pixel 31 as B3=B1/2, that is, a display component of a frame constituted by the second virtual pixel 3 is a half of a display component of part of a frame of the original image.

In such case, as illustrated in FIG. 8, "calculating a display component of a sub-pixel according to display components of second virtual sub-pixels of a same color as the sub-pixel in two adjacent second virtual pixels" can be: calculating a sum of products of display components of second virtual sub-pixels 31 of a same color in two adjacent second virtual pixels 3 in a column direction to obtain a display component of a sub-pixel 11 of the same color as the second virtual sub-pixels 31. Exemplarily, as illustrated in FIG. 8, the display components of two second virtual sub-pixels 31 of the same color are both B3, then the display component of the sub-pixel 11 is a sum of display components of the second virtual sub-pixels 31, that is, B4=2*B3. In FIG. 7, since a value of the display component B3 is ½ of a value of the display component B1, it obtains B4=B1; in such case, a display component of a frame constituted by the pixel 1 is the same as a display component of part of a frame in the original image, so that the color, the brightness and the like of the display frame remain the same, which generates an optimum display effect.

As illustrated in FIG. 8, in embodiments of the present disclosure, the sub-pixel 11 is calculated from display components of two adjacent second virtual sub-pixels 21, it can improve the visual resolution of the display frame. In addition, a line in a column direction displayed by two adjacent second virtual sub-pixels 31 is displayed by a single sub-pixel 11, that is, a line in a column direction of the display frame is displayed by the pixel 1, and a length (hereinafter referred to as width) of the pixel 1 in a row direction is ⅔ of a width of the second virtual pixel 3, while the width of the second virtual pixel 3 is 2 times of a width of the first virtual pixel 2, the width of the pixel 1 is 4/3 times of the width of the first virtual pixel 2, that is, nearly the same as the width of the first virtual pixel 2; as a result, the display effect of a line in a column direction of the display frame is similar to the display effect of a line in a column direction of a display frame in a strip-shaped arrangement manner.

Figure 9:
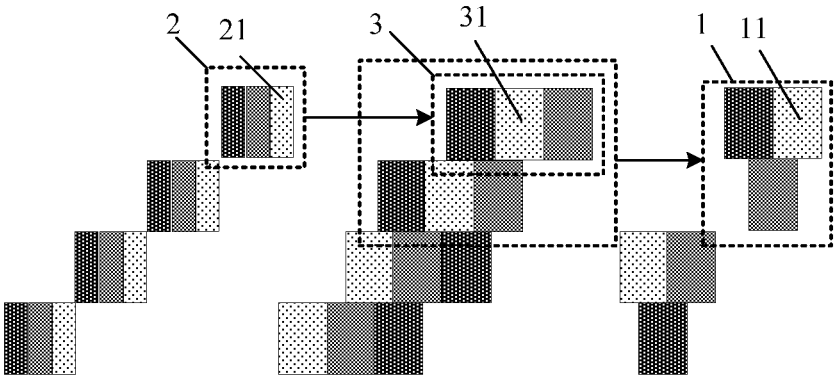
FIG. 9 is another schematic diagram illustrating a first display method as provided by an embodiment of the present disclosure.

Exemplarily, as illustrated in FIG. 9, in case that part of a frame in the original image is only displayed by first virtual pixels 2 in inclined directions, using the first display method allows the display effect of a line in a row direction of the display frame to be the same as the display effect of a line in a column direction of a display frame in a strip-shaped arrangement manner, and allows the display effect of a line in a column direction of the display frame to be similar to the display effect of a line in a column direction of a display frame in a strip-shaped arrangement manner.

Display Method II

The first solution in step S202 is described as below.

Exemplarily, "first virtual sub-pixels of a same color in at least two adjacent first virtual pixels" recorded in the first solution of step S202 includes: a first virtual sub-pixel having a same location and a same color as a second virtual sub-pixel in a single first virtual pixel, and a first virtual sub-pixel of a same color as the second virtual sub-pixel in at least one first virtual pixel adjacent to the above single first virtual pixel in a column direction.

Figure 10:
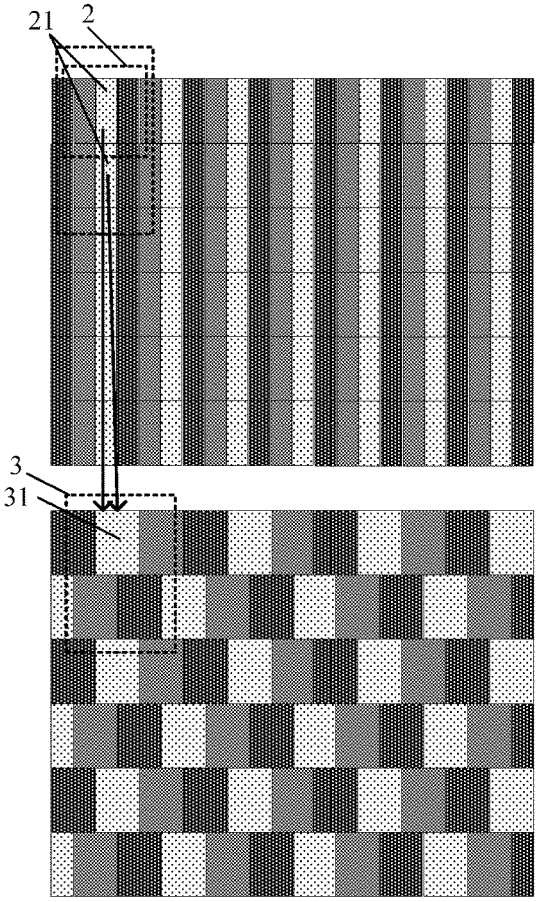
FIG. 10 is a schematic diagram illustrating a corresponding relationship between a second virtual sub-pixel and a first virtual sub-pixel in a second display method as provided by an embodiment of the present disclosure.

Only display components of first virtual sub-pixels of a same color in two adjacent first virtual pixels are selected for calculating the display component of the second virtual sub-pixel of the same color as the first virtual sub-pixels, and it can simplify the selection and also the calculation of the display component of the second virtual sub-pixel. As a result, it is described exemplarily hereinafter by referring the situation as shown in FIG. 10. That is, "first virtual sub-pixels of a same color in at least two adjacent first virtual pixels" includes: a first virtual sub-pixel 21 having a same location and a same color as a second virtual sub-pixel 31 in a single first virtual pixel 2, and a first virtual sub-pixel 21 of a same color as the second virtual sub-pixels 31 in a first virtual pixel 2 adjacent to the above single first virtual pixel 2 in a column direction.

In such case, the "calculating a display component of a second virtual sub-pixel according to display components of first virtual sub-pixels of a same color as the second virtual sub-pixel in two adjacent first virtual pixels" can be as follows.

As illustrated in FIG. 10, calculating a sum of products of multiplying display components of first virtual sub-pixels 21 of a same color in two adjacent first virtual pixels 2 in a column direction by respective proportional coefficients to obtain a display component of a second virtual sub-pixel 31 of the same color as the first virtual sub-pixels 21. Exemplarily, given that the display components of the two first virtual sub-pixels 21 of the same color are B5 and B6 respectively, and that the corresponding proportional coefficients are 0.4 and 0.5 respectively, then the display component of the second virtual sub-pixel 31 is B7=B5*0.4+B6*0.5. In such case, an overall display component of an image constituted by all the second virtual pixels 3 is smaller than an overall display component of the original image. Furthermore, for example, a sum of all the proportional coefficients used for calculating the display component of the second virtual sub-pixel 31 equals to 1 and the proportional coefficients of the first virtual sub-pixels 21 are identical with each other, so that an overall display component of an image constituted by all the second virtual pixels 3 is the same as an overall display component of the original image.

As illustrated in FIG. 10, since the second virtual sub-pixel 31 is co-determined by two first virtual sub-pixels 21, it can improve the visual resolution of the display panel constituted by the second virtual sub-pixel 31 to be approximate to a physical resolution of a display panel with a strip-shaped arrangement manner.

Figure 11:
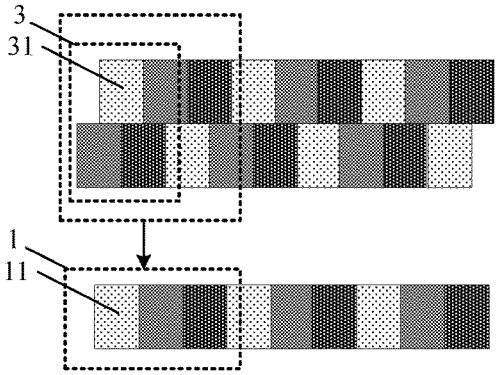
FIG. 11 is a schematic diagram illustrating a corresponding relationship between a sub-pixel and a second virtual sub-pixel in a second display method as provided by an embodiment of the present disclosure.

Subsequently, as illustrated in FIG. 11, "second virtual sub-pixels of a same color in two adjacent second virtual pixels" included in step S203 includes: a second virtual sub-pixel 31 having a same location and a same color as a sub-pixel 11 in a single second virtual pixel 3, and a second virtual sub-pixel 31 of a same color as the sub-pixel 11 in a second virtual pixel 3 adjacent to the above single second virtual pixel 3 in a row direction.

In such case, "calculating a display component of a sub-pixel according to second virtual sub-pixels of a same color as the sub-pixel in two adjacent second virtual pixels" can be as below.

As illustrated in FIG. 11, calculating a sum of products of multiplying display components of second virtual sub-pixels 31 of a same color in two adjacent second virtual pixels 3 in a row direction by respective proportional coefficients to obtain a display component of a sub-pixel 11 of the same color as the second virtual sub-pixels 31. In case that each of the proportional coefficients equals to 1, it can be: calculating a sum of display components of second virtual sub-pixels 31 of a same color in two adjacent second virtual pixels 3 in a column direction to obtain a display component of a sub-pixel 11 of the same color as the second virtual sub-pixels 31. Exemplarily, both of the display components of the two second virtual sub-pixels 31 are B7, then the display component of the sub-pixel 11 can be a sum of products of multiplying display components of the second virtual sub-pixels 31 by respective proportional coefficients, that is, B8=B7*0.3+B7*0.4; or, the display component of the sub-pixel 11 can be a sum of display components of the second virtual sub-pixels 31, that is, B8=B7*2.

In a conventional technology, for a display panel with the first structure, both the visual resolution of the display frame and the display effect of a line in the display frame are poorer than that of a display frame in a strip-shaped arrangement manner. In contrast, in embodiments of the present disclosure, as illustrated in FIG. 11, since the sub-pixel 11 is calculated from display components of two adjacent second virtual sub-pixels 21, it can improve the visual resolution of the display frame. Moreover, since a line in a column direction displayed by two adjacent second virtual sub-pixels 31 is displayed by a single sub-pixel 11, that is, the line in the column direction of the display frame is displayed by the pixel 1; and since a length (hereinafter referred to as "height") of the pixel 1 in a column direction is ½ of a height of the second virtual pixel 3, while the height of the second virtual pixel 3 is 2 times of a height of the first virtual pixel 2, the height of the pixel 1 is the same as the height of the first virtual pixel 2; as a result, the display effect of a line in a row direction of the display frame is the same as the display effect of a line in a row direction of a display frame in a strip-shaped arrangement manner.

Hereinafter the second solution in step S202 is described.

Figure 12:
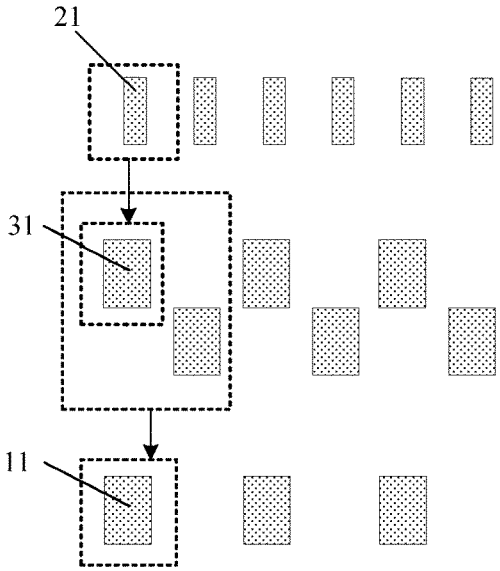
FIG. 12 is a schematic diagram illustrating a second display method as provided by an embodiment of the present disclosure.

Exemplarily, as illustrated in FIG. 12, "calculating a display component of a second virtual sub-pixel according to a display component of a single first virtual sub-pixel of a same color as the second virtual sub-pixel" in the second solution of step S202 can be: multiplying a display component of a single first virtual sub-pixel by a value greater than 0 and smaller than 1 to obtain a display component of a second virtual sub-pixel of a same color as the first virtual sub-pixel; Exemplarily, the display component of the first virtual sub-pixel 21 is B5, then multiplying the display component of the second virtual sub-pixel by a value such as 0.5 to obtain the display component of the second virtual sub-pixel 31 as B7=B5/2, that is, a display component of a frame constituted by the second virtual pixel 3 is a half of a display component of part of a frame in the original image.

In such case, as illustrated in FIG. 12, "calculating a display component of a sub-pixel according to display components of second virtual sub-pixels of a same color as the sub-pixel in two adjacent second virtual pixels" can be: calculating a sum of display components of second virtual sub-pixels 31 of a same color in two adjacent second virtual pixels 3 in a column direction to obtain a display component of a sub-pixel 11 of the same color as the second virtual sub-pixels 31. Exemplarily, as illustrated in FIG. 12, both of the display components of the two second virtual sub-pixels 31 of a same color are B3, then the display component of the sub-pixel 11 is a sum of the display components of the second virtual sub-pixels 31, that is, B8=2*B7. Since a value of the display component B7 in FIG. 12 is ½ of a value of the display component B5, it obtains B8=B5. In such case, a display component of a frame constituted by the pixel 1 is the same as a display component of part of a frame in the original image, so that the color, the brightness and the like of the display frame remain the same, which generates an optimum display effect.

Similar with the first structure, the embodiment above allows a line in a row direction of the display frame to have a display effect identical with that of a line in a column direction of a display frame in a strip-shaped arrangement manner, and allows a line in a column direction of the display frame to have a display effect similar to that of a line in a column direction of a display frame in a strip-shaped arrangement manner.

Display Method III

The first solution in step S202 is described as below.

In the step S202, "first virtual sub-pixels of a same color in at least two adjacent first virtual pixels" in the first solution includes: a first virtual sub-pixel having a same location and a same color as a second virtual sub-pixel in a single first virtual pixel, and a first virtual sub-pixel of a same color as the second virtual sub-pixel in at least one first virtual pixel adjacent to the above single first virtual pixel in a column direction.

Figure 13:
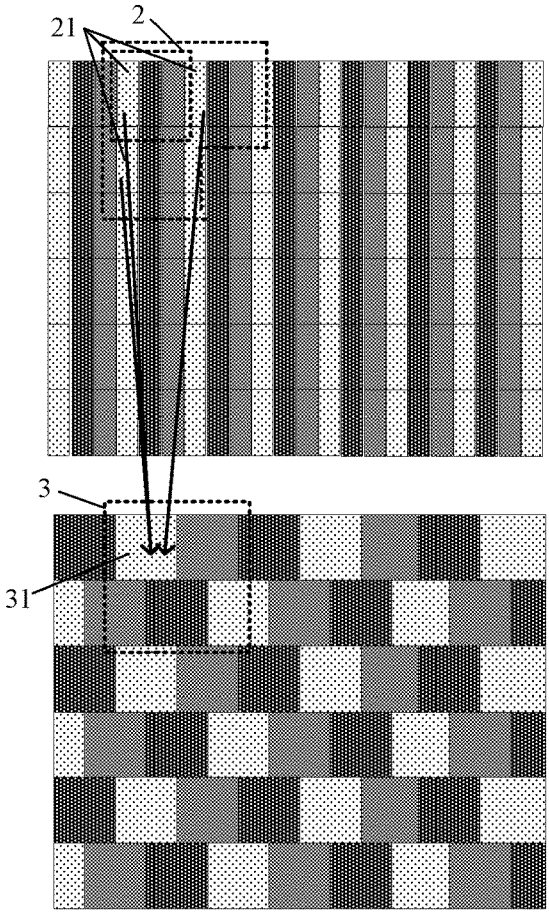
FIG. 13 is a schematic diagram illustrating a corresponding relationship between a second virtual sub-pixel and a first virtual sub-pixel in a third display method as provided by an embodiment of the present disclosure.

Only display components of first virtual sub-pixels of a same color in three adjacent first virtual pixels are selected for calculating the display component of the second virtual sub-pixel of the same color as the first virtual sub-pixels, it can simplify the selection and also the calculation of the display component of the second virtual sub-pixel. As a result, it is described exemplarily hereinafter by referring to the situation as shown in FIG. 13. That is, "first virtual sub-pixels of a same color in three adjacent first virtual pixels" includes: a first virtual sub-pixels 21 having a same location and a same color as a second virtual sub-pixel in a single first virtual pixel, a first virtual sub-pixel 21 of a same color as the second virtual sub-pixel 31 in a first virtual pixel 2 adjacent to the above single first virtual pixel 2 in a row direction, and a first virtual sub-pixel 21 of a same color as the second virtual sub-pixel 31 in a first virtual pixel 2 adjacent to the above single first virtual pixel 2 in a column direction.

In such case, "calculating a display component of a second virtual sub-pixel according to display components of first virtual sub-pixels of a same color as the second virtual sub-pixel in three adjacent first virtual pixels" can be as follows.

As illustrated in FIG. 13, calculating a sum of products of multiplying display components of first virtual sub-pixels 21 of a same color in three adjacent first virtual pixels 2 by respective proportional coefficients, to obtain a display component of a second virtual sub-pixel 31 of the same color. Exemplarily, given that the display components of the three first virtual sub-pixels 21 of a same color are B11, B12 and B13, respectively, and corresponding proportional coefficients thereof are 0.1, 0.2 and 0.5, respectively, then the display component of the second virtual sub-pixel 31 is B14=B11*0.1+B12*0.2+B13*0.5; in such case, an overall display component of an image constituted by all the second virtual pixels 3 is smaller than an overall display component of the original image.

For example, a sum of proportional coefficients of all the first virtual sub-pixels 21 used for calculating the display component of the second virtual sub-pixel 31 equals to 1, and the proportional coefficients are identical with each other, then an overall display component of an image constituted by all the second virtual pixels 3 is the same as an overall display component of the original image.

As illustrated in FIG. 13, since the second virtual sub-pixel 31 is co-determined by three first virtual sub-pixels 21, it can improve the visual resolution of a display panel constituted by the second virtual pixel 3 to be approximate to a physical resolution of a display panel in a strip-shaped arrangement manner.

Figure 14:
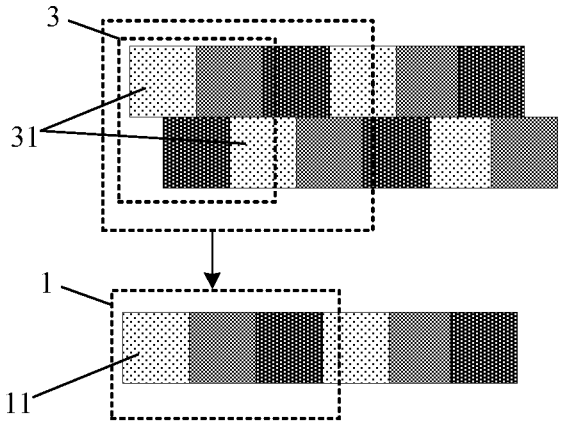
FIG. 14 is a schematic diagram illustrating a corresponding relationship between a sub-pixel and a second virtual sub-pixel in a third display method as provided by an embodiment of the present disclosure.

Subsequently, as illustrated in FIG. 14, "second virtual sub-pixels of a same color in two adjacent second virtual pixels" in step S203 includes: a second virtual sub-pixel 31 having a same location and a same color as a sub-pixel 11 in a single second virtual pixel 3, and a second virtual sub-pixel 31 of a same color as the sub-pixel 11 in a second virtual pixel 3 adjacent to the above single second virtual pixel 3 in a row direction.

In such case, "calculating a display component of a sub-pixel according to display components of second virtual sub-pixels of a same color as the sub-pixel in two adjacent second virtual pixels" in step S203 can be as follows:

As illustrated in FIG. 14, calculating a sum of products of multiplying display components of second virtual sub-pixels 31 of a same color in two second virtual pixels 3 adjacent in a row direction by respective proportional coefficients to obtain a display component of a sub-pixel 11 of the same color as the second virtual sub-pixels 31. In case that each of the above proportional coefficients equals to 1, it can be calculating a sum of display components of second virtual sub-pixels 31 of a same color in two adjacent second virtual pixels 3 in a column direction to obtain a display component of a sub-pixel 11 of the same color as the second virtual sub-pixels 31. Exemplarily, both of the display components of the two second virtual sub-pixels 31 of a same color are B14, then the display component of the sub-pixel 11 equals to a sum of products of multiplying the display components of the two second virtual sub-pixels 31 by respective proportional coefficients, that is, B15=B14*0.3+B14*0.2; or it can also equal to a sum of the display components of the second virtual sub-pixels 31, that is, B15=B14*2.

In a conventional technology, for a display panel with the third structure, both the visual resolution of the display frame and the display effect of a line in the display frame are poorer than that of a display frame in a strip-shaped arrangement manner. In contrast, in embodiments of the present disclosure, as illustrated in FIG. 14, since the sub-pixel 11 is calculated from display components of two adjacent second virtual sub-pixels 21, it can improve the visual resolution of the display frame. Moreover, a line in a row direction displayed by two adjacent second virtual sub-pixels 31 is displayed by a single sub-pixel 11, that is, a line in a row direction in the display frame is displayed by the pixel 1, and a height of the pixel 1 is ½ of a height of the second virtual pixel 3 while the height of the second virtual pixel 3 is 2 times of a height of the first virtual pixel 2, the height of the pixel 1 is the same as the height of the first virtual pixel 2; as a result, the display effect of a line in a row direction of the display frame is the same as the display effect of a line in a row direction of a display frame in a strip-shaped arrangement manner.

Regarding the second solution in step S202, reference can be made to the foregoing related description without repeating herein.

Based on the first, second and third display methods, it can be seen that the display effect of a line in a column direction of a display frame of a display panel with the first structure is better than the display effect of a line in a column direction of a display frame of a display panel with the second structure; as a result, for example, a display panel with the first structure is selected for a display device. Correspondingly, for example, the first and second display methods are selected for a display method of a display panel with the first structure.

In addition, for example, in the first, second and third display methods, a display component of the sub-pixel is larger than a display component of a second virtual sub-pixel of a same color as the sub-pixel, which can optimize the display effect of a line as displayed.

Embodiments of the present disclosure provide a display method applicable for display panels in which sub-pixels are arranged in a triangle-shaped arrangement manner, the display method includes: generating an original image including a plurality of first virtual pixels according to image information, each of the first virtual pixels includes a plurality of first virtual sub-pixels of different colors, the first virtual sub-pixels are arranged in a strip-shaped arrangement manner; and then calculating a display component of a second virtual sub-pixel according to display components of first virtual sub-pixels of a same color as the second virtual sub-pixel in at least one first virtual pixel. The second virtual sub-pixel and the sub-pixel have a same length in a row direction and in a column direction, and a second virtual pixel includes a plurality of second virtual sub-pixels of different colors. Finally, calculating a display component of a sub-pixel according to display components of second virtual sub-pixels of a same color as the sub-pixel in at least two adjacent second virtual pixels. The display component of the sub-pixel is calculated from second virtual sub-pixels of a same color as the sub-pixel in at least two adjacent second virtual pixels, that is, the sub-pixel is co-determined by at least two second virtual sub-pixels, it can improve the visual resolution; furthermore, a line displayed by at least two adjacent second virtual sub-pixels is displayed by a single sub-pixel, it can improve the display effect of a line in the display frame.

Embodiments of the present disclosure provide a display method. The second virtual sub-pixel and the sub-pixel have a same length in a row direction and a column direction, that is, second virtual sub-pixels and sub-pixels are all arranged in a triangle-shaped arrangement manner, and a display component of a single sub-pixel is obtained from display components of at least two adjacent second virtual sub-pixels which allows a single sub-pixel to be displayed by at least two second virtual sub-pixels, it can improve the visual resolution of the display panel, and allows a line displayed by at least two second virtual sub-pixels to be displayed by a single sub-pixel, and optimize the display effect of a line in a display frame in a triangle-shaped arrangement manner.

The Second Embodiment

Figure 15:
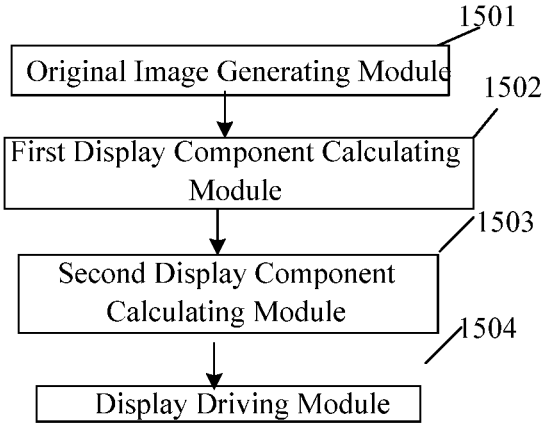
FIG. 15 is a schematic diagram illustrating a structure of a display device as provided by an embodiment of the present disclosure.

Embodiments of the present disclosure provide a display device. The display device has a display panel including a plurality of sub-pixels arranged in a triangle-shaped arrangement manner. As illustrated in FIG. 15, the display device further includes: an original image generating module 1501 configured to generate an original image including a plurality of first virtual pixels according to image information, each of the first virtual pixels includes a plurality of first virtual sub-pixels of different colors, the first virtual sub-pixels are arranged in a strip-shaped arrangement manner; a first display component calculating module 1502 connected to the original image generating module 1501 and configured to calculate a display component of a second virtual sub-pixel according to display components of first virtual sub-pixels of a same color as the second virtual sub-pixel in at least one first virtual pixel, the second virtual sub-pixel and the sub-pixel having a same length in a row direction and a column direction, and a second virtual pixel includes a plurality of second virtual sub-pixels of different colors; a second display component calculating module 1503 connected to the first display component calculating module 1502 and configured to calculate a display component of a sub-pixel according to display components of second virtual sub-pixels of a same color as the sub-pixel in at least two adjacent second virtual pixels; and a display driving module 1504 connected to the second display component calculating module 1503 and configured to drive respective sub-pixels of the display panel to display according to respective display components.

For example, the first display component calculating module 1502 includes: a first sampling device connected to the original image generating module 1501 and configured to sample the first virtual sub-pixel to obtain first virtual sub-pixels of a same color in at least one first virtual pixel; and a first calculating device connected to the first sampling device and configured to calculate a display component of a second virtual sub-pixel according to display components of first virtual sub-pixels of a same color as the second virtual sub-pixel in at least one first virtual pixel as obtained by the first sampling device. The second display component calculating module 1503 includes: a second sampling device connected to the first calculating device and configured to sample the second virtual sub-pixel to obtain second virtual sub-pixels of a same color in at least two adjacent second virtual pixels; and a second calculating device connected to the second sampling device and configured to calculate a display component of a sub-pixel according to display components of second virtual sub-pixels of a same color as the sub-pixel in at least two adjacent second virtual pixels as obtained by the second sampling device.

Exemplarily, in the embodiment above, the first calculating device can be configured to calculate a sum of products of multiplying display components of first virtual sub-pixels of a same color in at least two adjacent first virtual pixels as sampled by the first sampling device to obtain a display component of a second virtual sub-pixel of a same color as the first virtual sub-pixels. The second virtual sub-pixel has an overlapping area with a single first virtual sub-pixel.

Exemplarily, the first calculating device can be further configured to calculate a display component of a second virtual sub-pixel according to a display component of a single first virtual sub-pixel of a same color as the second virtual sub-pixel as sampled by the first sampling device. The second virtual sub-pixel has an overlapping area with the first virtual sub-pixel.

Exemplarily, in the embodiment above, the second calculating device can be configured to, for example, calculate a sum of products of multiplying display components of second virtual sub-pixels of a same color in at least two adjacent second virtual pixels as sampled by the second sampling device to obtain a display component of a sub-pixel of the same color as the second virtual sub-pixels. The sub-pixel has an overlapping area with a single second virtual sub-pixel.

Exemplarily, in the embodiment above, the first sampling device can be configured to sample the first virtual sub-pixel to obtain: a first virtual sub-pixel having a same location and a same color as a second virtual sub-pixel in a single first virtual pixel, and a first virtual sub-pixel of a same color as the second virtual sub-pixel in at least one first virtual pixel adjacent to the single first virtual pixel in a row direction or a column direction.

Exemplarily, in the embodiment above, the first sampling device can be further configured to sample the first virtual sub-pixel to obtain: a first virtual sub-pixel having a same location and a same color as a second virtual sub-pixel in a single first virtual pixel, a first virtual sub-pixel of a same color as the second virtual sub-pixel in at least one first virtual pixel adjacent to the single first virtual pixel in a row direction, and a first virtual sub-pixel of a same color as the second virtual sub-pixel in at least one first virtual pixel adjacent to the single first virtual pixel in a column direction.

Exemplarily, in the embodiment above, the second sampling device can be configured to, for example, sample the second virtual sub-pixel to obtain: a second virtual sub-pixel having a same location and a same color as a sub-pixel in a single second virtual pixel, and a second virtual sub-pixel of a same color as the sub-pixel in a second virtual pixel adjacent to the single second virtual pixel in a row direction or a column direction. The display device can be liquid crystal panel, tablet computer, television, display, notebook computer and any other product or component having display function.

Embodiments of the present disclosure provide a display device. The display component calculating module allows the display component of the sub-pixel to be obtained by second virtual sub-pixels of a same color as the sub-pixel in two adjacent second virtual pixels, that is, the sub-pixel is co-determined by two second virtual sub-pixels, it can improve the visual resolution. Furthermore, a line displayed by two adjacent second virtual sub-pixels is displayed by a single sub-pixel, it can improve the display effect of a line in the display frame.

Embodiments of the present disclosure provide a display device. The second virtual sub-pixel and the sub-pixel have a same length in a row direction and a column direction, and the display component calculating modules allow the display component of the sub-pixel to be calculated from display components of at least two adjacent second virtual sub-pixels, it can improve the visual resolution and allows a line displayed by at least two second virtual sub-pixels to be displayed by a single sub-pixel, and optimize the display effect of a line in the display frame in a triangle-shaped arrangement manner.

The described above are only illustrative implementations for explaining the present disclosure, and the present disclosure is not limited thereto. For one of ordinary skill in the art, various modifications and improvements may be made without departing from the spirit and scope of embodiments of the present disclosure, and modifications and improvements shall fall within the scope of the present disclosure.

The present application claims priority of Chinese Patent Application No. 201510303504.5 filed on Jun. 5, 2015 and entitled "A DISPLAY METHOD AND A DISPLAY DEVICE", the disclosure of which is incorporated herein by reference in its entirety as part of the present application.

What is claimed is:

1. A display method applicable in a display panel in which sub-pixels are arranged in a triangle-shaped arrangement manner, the display method comprises:

generating an original image comprising a plurality of first virtual pixels according to image information, each of the first virtual pixels including a plurality of first virtual sub-pixels of different colors, and the first virtual sub-pixels being arranged in a strip-shaped arrangement manner;

calculating a display component of each of a plurality of second virtual sub-pixels of different colors included in a second virtual pixel according to display components of three or more first virtual sub-pixels of a same color as a corresponding second virtual sub-pixel of the plurality of second virtual sub-pixels, the three or more first virtual sub-pixels of the same color being from at least two adjacent first virtual pixels in a row direction and from at least two adjacent first virtual pixels in a column direction, each first virtual sub-pixel and each sub-pixel of a same color having a same length in the column direction, and each second virtual sub-pixel and each sub-pixel of a same color having a same length in the row direction and in the column direction; and calculating a display component of each of the sub-pixels according to the display component of each of the plurality of second virtual sub-pixels of the same color in at least two adjacent second virtual pixels.

2. The display method according to claim 1, further comprising:

calculating a sum of products of multiplying display components of first virtual sub-pixels of the same color in the at least two adjacent first virtual pixels in the row direction and the column direction by respective proportional coefficients to obtain the display component of the corresponding second virtual sub-pixel of the same color of the plurality of second virtual sub-pixels, each second virtual sub-pixel having an overlapping area with a corresponding first virtual sub-pixel of a same color.

3. The display method according to claim 2, wherein a sum of proportional coefficients of all the first virtual sub-pixels configured to calculate the display component of each of the plurality of second virtual sub-pixels equals to 1.

4. The display method according to claim 3, wherein the proportional coefficients used for calculating the display components of each of the plurality of second virtual sub-pixels are identical with each other.

5. The display method according to claim 2, further comprising:

calculating a sum of products of multiplying a display component of each of the plurality of second virtual sub-pixels of the same color in at least two adjacent second virtual pixels by respective proportional coefficients to obtain the display component of each of the sub-pixels of the same color as the corresponding second virtual sub-pixels, each first virtual sub-pixel having an overlapping area with a corresponding second virtual sub-pixel.

6. The display method according to claim 2, wherein the three or more first virtual sub-pixels of the same color in the at least two adjacent first virtual pixels in the row direction and in the column direction comprise:

a first virtual sub-pixel from one of the at least two adjacent first virtual pixels in the row direction and in the column direction having a same location and the same color as the corresponding second virtual sub-pixel, and two first virtual sub-pixels from at least two first virtual pixels adjacent to the one of the at least two adjacent first virtual pixels in the row direction and the column direction having the same color as the corresponding second virtual sub-pixel.

7. The display method according to claim 2, wherein the three or more first virtual sub-pixels of the same color in the at least two adjacent first virtual pixels in the row direction and in the column direction comprises:

a first virtual sub-pixel from one of the at least two adjacent first virtual pixels in the row direction having a same location and the same color as the corresponding second virtual sub-pixel, a first virtual sub-pixel from one of the at least two first virtual pixels adjacent to the one first virtual pixel in the row direction having the same color as the second virtual sub-pixel, and a first virtual sub-pixel from one of the at least two first virtual pixels adjacent to the virtual pixel in the column direction having the same color as the second virtual sub-pixel.

8. The display method according to claim 1, wherein the second virtual sub-pixel of the same color in the at least two adjacent second virtual pixels comprises:

a second virtual sub-pixel in one of the at least two adjacent second virtual pixels having a same location and the same color as the sub-pixel, and a second virtual sub-pixel in another second virtual pixel adjacent to the one of the at least two adjacent second virtual pixels in the row direction or the column direction having the same color as the sub-pixel.

9. The display method according to claim 1, wherein each of the plurality of second virtual sub-pixels has an overlapping area with a corresponding first virtual sub-pixel of the same color.

10. The display method according to claim 1, wherein the display component of the each sub-pixel is greater than the display component of the corresponding second virtual sub-pixel of the same color as the each sub-pixel.

11. The display method according to claim 1, wherein a sum of proportional coefficients of all of the first virtual sub-pixels used to calculate the display components of each of the second virtual sub-pixels equals to 1.

12. The display method according to claim 1, wherein proportional coefficients used for calculating the display component of each of the second virtual sub-pixels are identical with each other.

13. The display method according to claim 1, wherein a length of a pixel in a row direction is ⅔ of a width of a corresponding second virtual pixel, a width of the pixel is 4/3 times of the width of a corresponding first virtual pixel.

14. The display method according to claim 13, wherein a length of each first virtual sub-pixel in the row direction is ⅓ of a length of a corresponding first virtual sub-pixel in the column direction.

15. The display method according to claim 1, wherein a width of each second virtual pixel is 2 times of a width of a corresponding first virtual pixel.

* * * * *